US005892381A

United States Patent [19]

Koifman et al.

[11] Patent Number: 5,892,381

[45] Date of Patent: Apr. 6, 1999

[54] FAST START-UP CIRCUIT

[75] Inventors: Vladimir Koifman, Rishon-Lezion; Yachin Afek, Kfar Saba; Eliezer Sand, Hod-Hasharon, all of Israel; Kiyoshi Kase, Pflugerville, Tex.

[73] Assignee: Motorola, Inc., Schaumburg, Ill.

[21] Appl. No.: 868,335

[22] Filed: Jun. 3, 1997

[51] Int. Cl.[6] ..... G05F 3/16

[52] U.S. Cl. ..... 327/198; 327/143; 327/541; 327/546; 323/314

[58] Field of Search ..... 327/198, 170, 327/143, 545, 546, 72, 73, 344, 532, 540, 541, 542, 543; 323/281, 313, 314, 901

[56] References Cited

U.S. PATENT DOCUMENTS 5,027,053 6/1991 Ohri et al. ..... 323/314
5,281,866 1/1994 Rundel ..... 327/546
5,317,254 5/1994 Olson ..... 327/546
5,698,973 12/1997 Goerke et al. ..... 323/901
5,734,281 3/1998 Morishima et al. ..... 327/198

*Primary Examiner*—Timothy P. Callahan
*Assistant Examiner*—Terry L. Englund
*Attorney, Agent, or Firm*—Robert M. Handy

[57] ABSTRACT

The rise time of a voltage Vo presented to a load, based on an input voltage Vi provided via an RC filter coupled to the load for removing higher frequency noise on Vo, is substantially reduced by providing a sensor circuit with differential inputs Vi, Vo. The sensor circuit drives a charger circuit coupled to a DC potential and the load so that rapid charging of C to Vo does not depend on R. As Vo approaches Vi, the sensor circuit deactivates the charger circuit to stop further charging and a latch coupled to the sensor circuit shuts off the sensor circuit to reduce power consumption while (Vo~Vi)>0. A current mirror buffer is desirably included between the sensor output and the latch for level shifting.

20 Claims, 3 Drawing Sheets

-PRIOR ART-

FAST START-UP CIRCUIT

FIELD OF THE INVENTION

This invention concerns electronic circuits having an accelerated rise time.

BACKGROUND OF THE INVENTIONS

Many analog circuits have a long start-up time which is often controlled by an RC time constant. An example is shown in prior art circuit 10 of FIG. 1. Circuit 10, by way of example, has voltage reference source 2 ("V-REF. SOURCE") which is supplying, among other elements, load 4 ("LOAD") via resistor 6 of value R with filter capacitance 12 of value C. Load 4 is often an analog load.

In many applications, it is desirable that voltage Vo appearing on input 5 of load 4 from node 8 have very low noise. Resistor 6 and capacitance 12 act as a low pass filter to attenuate noise present on voltage Vi on output 3 from source 2. Resistor 6 is conveniently located within boundary 9 of integrated circuit (IC) 11 containing source 2 and load 4, but this is not essential. Resistance R can include the internal impedance of source 2. Capacitance 12 has input connection 7 coupled to node 8 and another lead coupled to reference 13, e.g., GND. Capacitance 12 is usually external to IC 11 because of its comparatively large size, but this is not essential.

It is often the case that the RC time constant $T_{RC}$ associated with circuit 10 can be relatively large, e.g., 10–1000 milliseconds. The time $T_S$ for the voltage Vo to stabilize after Vi is turned on is usually about $T_S=3\times T_{RC}$. For many applications long stabilization times are undesirable. For example, the operation of a cellular phone can often require that it wake-up and go back to sleep many times a second. Having to wait 30–100 milliseconds for voltage Vo on node 8 and input 5 to stabilize is a great disadvantage. Such slow response time can adversely affect the cell-phone performance. Further, if the phone cannot respond quickly enough to a wake-up command, it may be necessary to leave it in a wake-state for longer periods of time, thus increasing power consumption and battery drain, and shortening the operating time between battery recharge. This is not desirable.

Thus, there continues to be a need for electronic apparatus with faster start-up characteristics, especially in connection with high impedance sources or when a low pass filter is included to reduce noise or both. It is desirable that faster start-up be achieved without great added circuit complexity and, if possible, without significantly increasing power consumption. Accordingly, a purpose of this invention is to provide electronic apparatus as recited in the claims which overcomes, in whole or part, these and other deficiencies or limitations of the prior art.

BRIEF DESCRIPTION OF THE DRAWINGS

Like reference numbers are used in the figures to identify like elements and primed or double-primed reference numbers to identify analogous or related elements.

DETAILED DESCRIPTION OF THE PREFERRED EMBODIMENT

While capacitance 12 in FIGS. 2–5 is identified for convenience of explanation as a "filter" capacitance, those of skill in the art will understand based on the description herein that capacitance 12 can serve any desired purpose. What matters is that the value of Vo at input 5 of load 4 depends upon the charge on capacitance 12.

Figure 1:
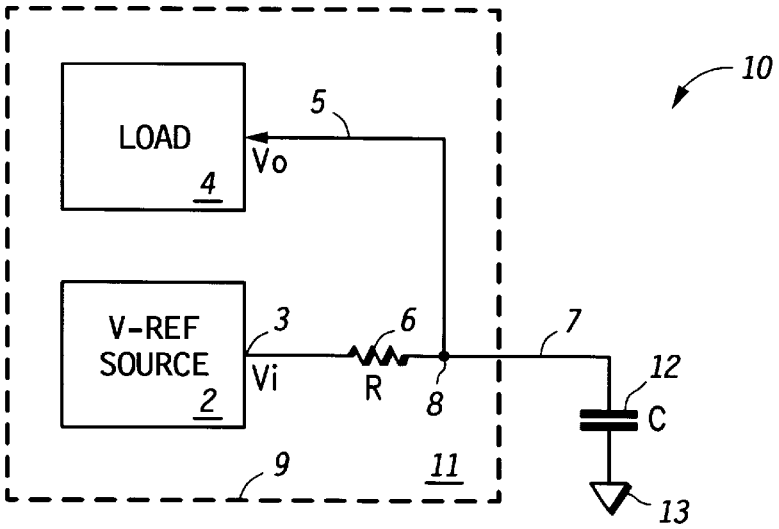
FIG. 1 is a simplified schematic drawing of a prior art circuit illustrating how the problem being solved by the present invention can arise.
Figure 2:
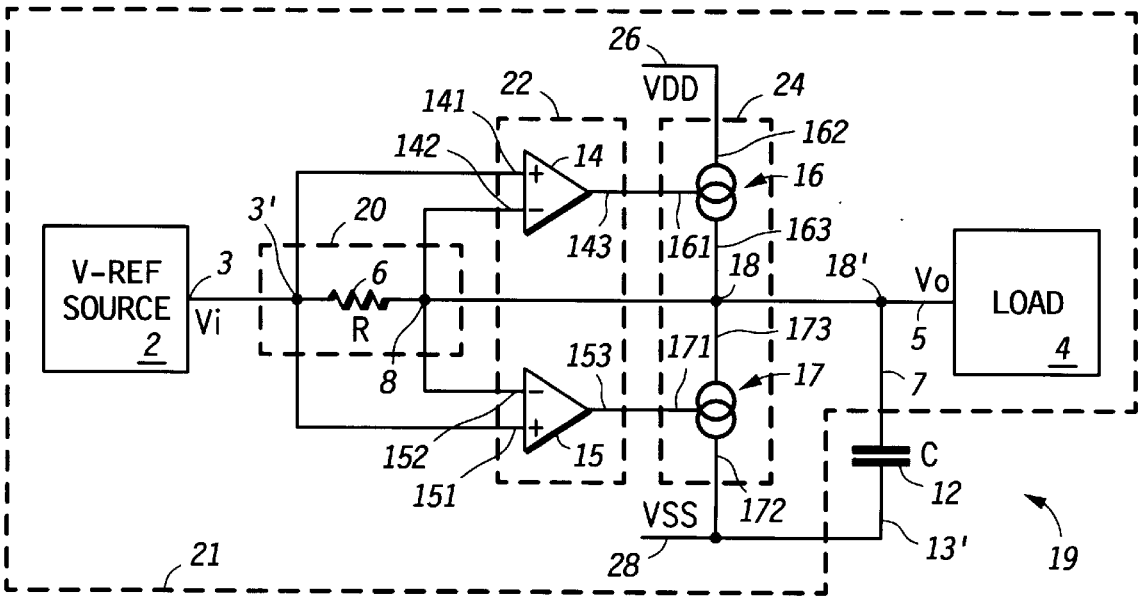
FIG. 2 is a simplified schematic block diagram of a first embodiment of the present invention.

FIG. 2 is a simplified schematic block diagram of system 19 according to a first embodiment of the present invention. System 19 conveniently comprises circuit 21 and capacitance 12. Circuit 21 is preferably an integrated circuit. Capacitance 12 can be internal or external to IC 21. System 19 can be composed of separate as well as integrated elements, that is, it need not be integrated although that is more convenient. Circuit 21 preferably includes source 2 which provides Vi and load 4 which receives Vo, as in FIG. 1, plus sensor element 20, sensing circuit 22 and charger circuit 24. While sensor element 20 is illustrated as comprising series resistance 6, any other means for providing Vi and Vo to sensing circuit 22 and a continuous charging path to capacitance 12 can also be used.

For purposes of explanation, it is assumed that the rise time of voltage Vi is negligible relative to $T_{RC}$ and that, without the modifications shown in FIGS. 2–5, the rise time of voltage Vo would be substantially determined by the time constant $T_{RC}$ of resistor 6 and capacitance 12 having values R and C, respectively. Ordinarily, capacitance 12 is so large compared to the input capacitance of the other elements which are connected to the same nodes, that their input capacitance can be neglected, but this is not essential, since their input capacitance merely adds to capacitance 12.

Sensor circuit 22 preferably comprises differential amplifiers (e.g., op-amps) 14, 15 having inputs 141, 142 and 151, 152 that are coupled to nodes 3', 8 of sensor element 20 as illustrated in FIG. 2. Amplifiers 14, 15 have a predetermined voltage offset (Vos) greater than zero volts. Vos is usefully in the range $5 \leqq Vos \leqq 100$ millivolts, more conveniently in the range $10 \leqq Vos \leqq 70$ and preferably about 50 millivolts, but larger or smaller values Vos>0 can also be used. Stated another way, Vos should be in the range of 1% to 10% of Vi, more preferably in the range of about 2% to 5% of Vi. The operating window of circuit 21 has a range of approximately twice these values.

The offset amount is chosen to take into account the maximum variation that is expected from the manufacturing process used to fabricate circuit 21, and the amount of noise that is expected to be present on Vi. It is important that Vos be greater than zero under all active conditions so that current sources 16, 17 are not both ON at the same time since this could allow a heavy current to flow directly between rails 26, 28. Vos of amplifiers 14, 15 are conveniently about equal, but this is not essential.

Outputs 143, 153 of amplifiers 14, 15 are coupled, respectively to control inputs 161, 171 of variable current sources 16, 17 of charger circuit 24. First main current terminals 162, 172 of current sources 16, 17 are coupled to DC voltages (e.g., VDD, VSS) on power rails 26, 28, respectively. Second main current terminals 163, 173 of current sources 16, 17 are coupled to common node 18. Common node 18 is coupled, via nodes 8 and 3' to output 3 of source 2, and via node 18' to input 5 of load 4 and input 7 of capacitance 12.

Sensor circuit 22 receives Vi from sensor element 20 via inputs 141, 151. It also receives Vo from sensor element 20 via inputs 142, 152. Thus, the signal appearing on outputs 143, 153 and inputs 161, 171 depends upon the voltage difference (Vi−Vo).

Figure 3:
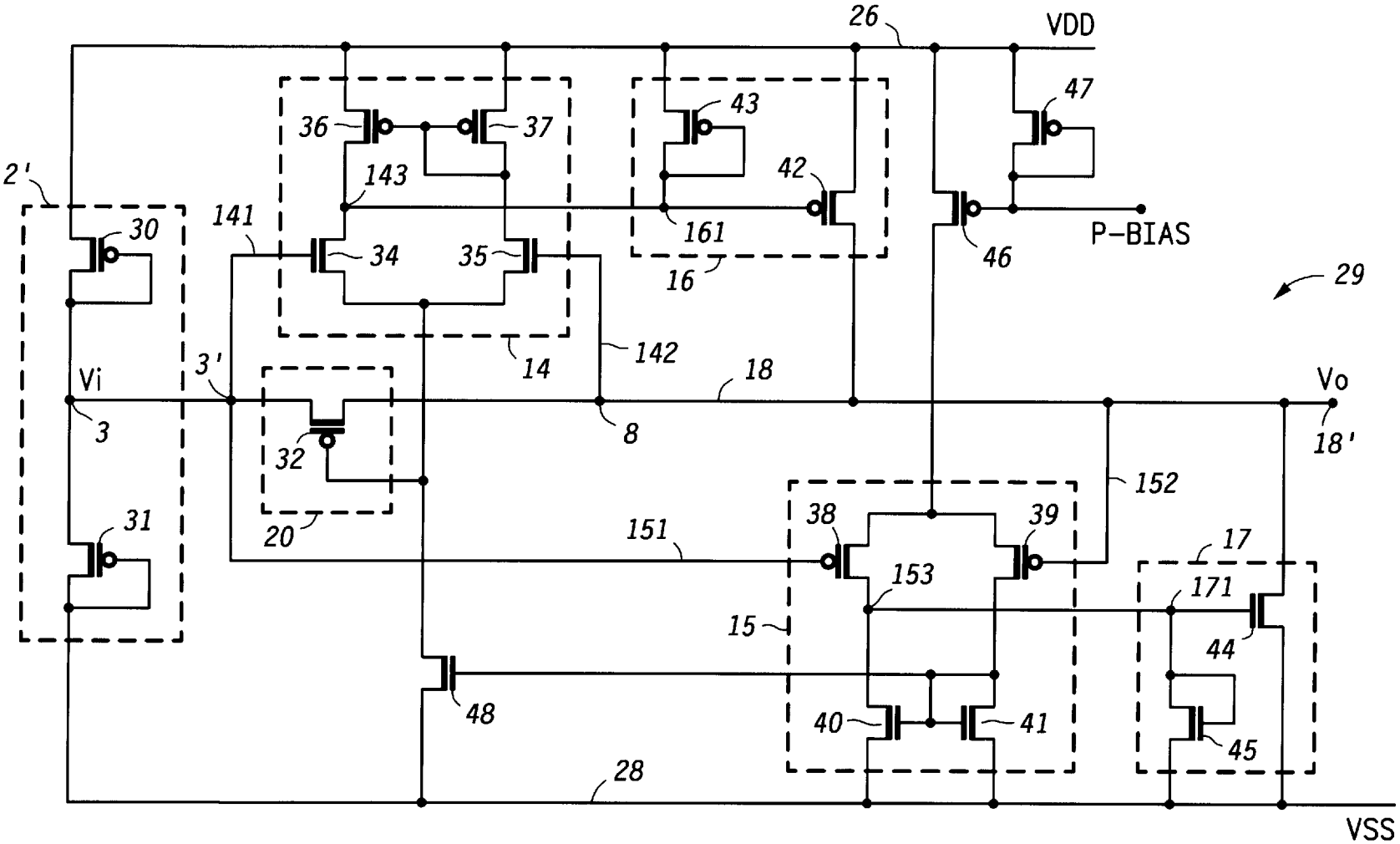
FIG. 3 is a simplified schematic circuit diagram corresponding to the block diagram of FIG. 2 but showing further detail.

FIG. 3 is a simplified schematic diagram of circuit 29 corresponding to system 19 of FIG. 2, showing further details, but without load 4 or capacitor 12. Transistors 30–32, 34–47, coupled as shown in FIG. 3 are used in this example to implement the block diagram of FIG. 2. In FIG. 3, Vi~(VDD-VSS)/2 and is generated by means of transistors 30, 31 which function as substantially equal resistances to provide source 2' for reference voltage Vi. This is not intended to be limiting and any source of Vi can be used. The operation of the circuit of FIGS. 2 and 3 is explained by way of the following non-limiting example. Unless otherwise noted, the parameters Vi, Vo and mathematical operations Vi−Vo, etc., refer to magnitudes. The symbol "~" is used to indicate that the quantities or parameters referred to are substantially equal.

Assume that (VDD-VSS)~2.7 volts, and Vi~1.35 volt with about 100 millivolt peak-to-peak (PP) noise superimposed thereon. In that case, the off-set voltages of op-amps 14, 15 of sensor circuit 22 are each set to about 50 millivolts. This provides an operating window of ~100 millivolts. When (VDD-VSS) in FIG. 3 is raised from 0 to ~2.7 volts, Vi becomes ~1.35 volts, but Vo is still at ~0 volts since capacitor 12 has not yet charged. (Vi−Vo) appears across resistor 6 and inputs 141, 142 and 151, 152 of op-amps 14, 15. Op-amps 14, 15 are such that, for this input condition, the polarity of the signals appearing on amplifier outputs 143, 153 and on inputs 161, 171 of variable current sources 16, 17, are such as to turn on variable current source 16 and begin charging capacitance 12 connected to output 18'. The charging time constant does not depend on the resistance of sensing element 20 (e.g., resistor 6 in FIG. 2 or transistor 32 in FIG. 3), and can be made as short as is desired by reducing the internal impedance of current source 16.

As capacitance 12 charges, Vo increases and Vi−Vo decreases. When (Vi−Vo)~$Vos_{14}$, where $Vos_{14}$ is the off-set voltage of amplifier 14, then amplifier 14 turns off current source 16, so that charging via current source 16 stops and any remaining charging takes place via resistor 6. Variable current source 16 stays off as long as the condition Vo≧Vi−$Vos_{14}$ is satisfied. If Vo exceeds Vi+$Vos_{15}$, where $Vos_{15}$ is the off-set voltage of amplifier 15, then amplifier 15 turns on variable current source 17 and drains charge from capacitor 12 until Vo~Vi+$Vos_{15}$. Thus, the operation of the arrangement of FIGS. 2–3 is double sided, that is, it provides both faster charging and faster discharging of capacitor 12, independent of the value of R, so that Vo remains within the operating range or voltage "window" (Vi−$Vos_{14}$)≦(Vo)≦(Vi+$Vos_{15}$). Where $Vos_{14}$−$Vos_{15}$~50 millivolts, the operating window is about 100 millivolts.

The noise components on Vi are attenuated by the low pass RC filter. Further, by designing amplifiers 14, 15 to be low frequency amplifiers, any high speed transients or high frequency noise on Vi beyond the cut-off frequency of amplifiers 14, 15 do not propagate through amplifiers 14, 15 and are effectively attenuated.

Circuit 29 of FIG. 3 was simulated and compared to the circuit of FIG. 1 for the same values $T_{RC}$. C was approximately 0.1 microFarads. The settling time for Vo was reduced from about 3000 milliseconds to about 15 milliseconds. This value of capacitance is sufficient to satisfactorily attenuate 100 millivolts RMS (500 millivolt PP) power supply noise riding on the nominal Vi value of 1.35 volts, indicating that the addition of the speed-up circuit of FIGS. 2–3 does not interfere significantly with the operation of the low-pass filter.

The speed-up circuit of FIGS. 2–3 is very useful. It substantially decreases the settling time of Vo without adding undue complexity to the overall integrated circuit. Further, current sources 16, 17 are only active when needed to quickly pull Vo up or down to close to the desired level. In standby when Vi~0 or when Vi>0 and Vo~Vi, charger circuit 24 draws no power. Since current sources 16, 17 (when ON) are among the largest users of power in the speed-up circuit, having them turned OFF except when needed to accelerate turn-on and turn-off of Vo, is a great advantage. This is accomplished by means of the off-set provided in amplifiers 14, 15 which insures that current sources 16, 17 are in the off state when Vo~Vi±Vos.

However, amplifiers 14, 15 operate continuously. In battery powered applications when every care should be taken to minimize system power drain, this can be a disadvantage. Also, the need to have significant off-set voltages for amplifiers 14, 15 makes it more difficult to obtain a precision value of Vo when such is required. This is often the case when source 2 producing Vi, for example, is a band-gap voltage reference which Vo must precisely reproduce.

Figure 4:
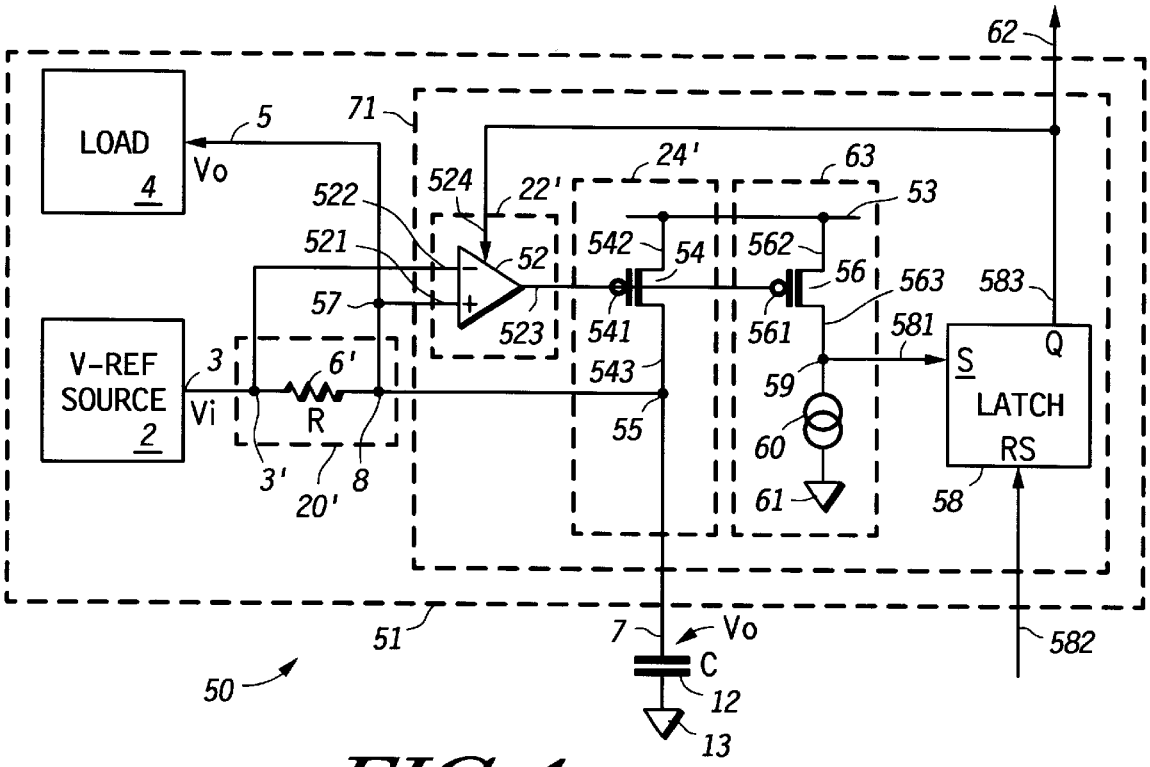
FIG. 4 is a simplified schematic block diagram of another embodiment of the present invention.
Figure 5:
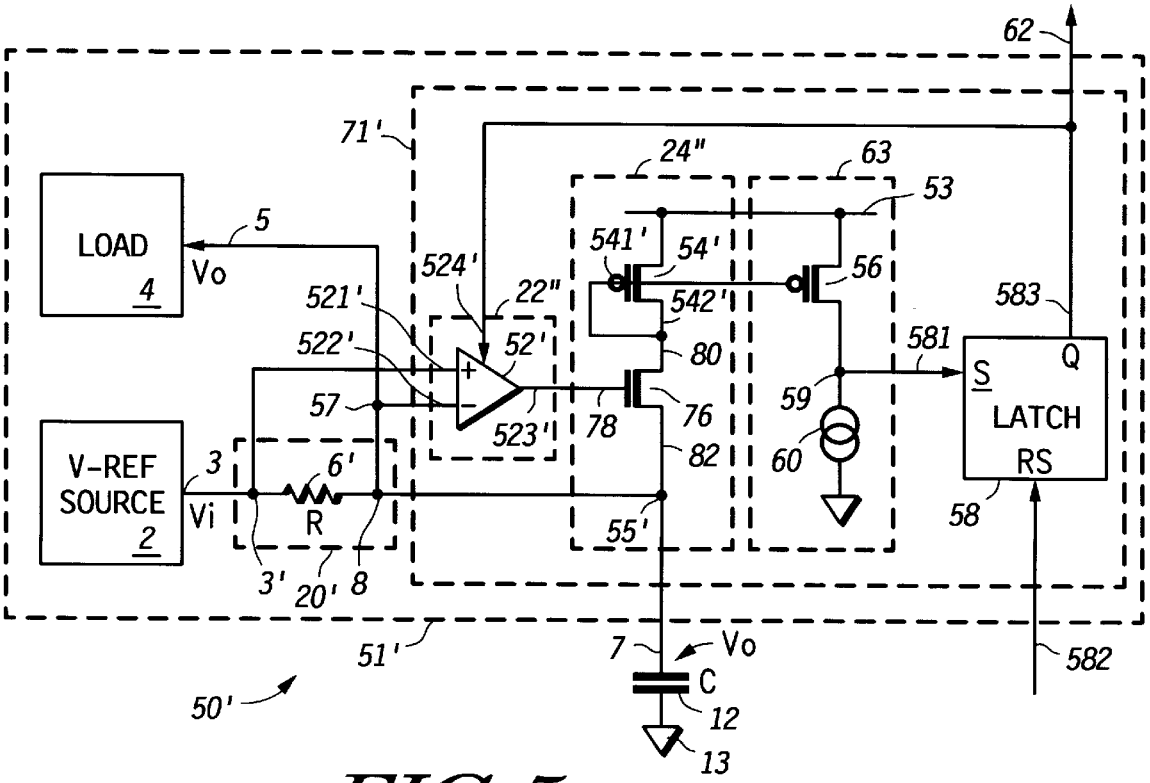
FIG. 5 is a simplified schematic diagram analogous to FIG. 4, but according to a still further embodiment of the present invention.

The arrangement illustrated in FIGS. 4–5 show how the limitations of the arrangement of FIGS. 2–3 can be avoided. FIG. 4 is a simplified schematic diagram in which overcharging is avoided and the sensor circuit as well as the charger circuit is automatically turned off after fast charging is complete in order to further conserve power. FIG. 5 is analogous to FIG. 4, but according to a still further embodiment of the present invention. In FIGS. 4–5, dashed outlines identified by primed reference numbers 20', 22', 22", 24', 24" are included to identify those combinations of elements which provide analogous or related functions to circuit portions 20, 22, 24 of FIG. 2, but which can differ in detail and result.

For simplicity of explanation, the circuits of FIGS. 4–5 are single sided fast charging circuits, that is, they accelerate charging of capacitor 12 for Vo<Vi up to Vo18 Vi. The double-sided circuit of FIGS. 2–3, accelerate both charging when Vo<Vi−Vos and discharging when Vo>Vi+Vos. Persons of skill in the art will understand based on the description herein how to modify the circuits of FIGS. 4–5 to provide double sided action if that is desired.

Referring now to FIG. 4, fast charging system 50 comprises voltage reference source 2 producing Vi, and load 4 and capacitance 12 of value C which receive Vo, as in FIGS. 1–2. For convenience of explanation the elements are illustrated as being contained within boundary of integrated circuit 51, but this is not essential. Resistor 6' and capacitance 12 form a noise attenuating RC filter and create the intrinsic RC time constant $T_{RC}$ of circuit 50 in the same way as with circuit 10 of FIG. 1 and circuit 19 of FIG. 2.

Voltage Vi appears at node 3' when source 2 is active. Source 2 may be powered-up continuously and its output voltage applied or disconnected from node 3 by "wake-up" or "sleep" signals applied, for example, to a series switch (not shown). Alternatively, source 2 can be turned on and off in response to such "wake-up" or "sleep" signals provided by other parts (not shown) of the overall system. Either arrangement is useful and immaterial to the present invention. It is assumed for purposes of explanation that the rise time of Vi is negligible compared to $T_{RC}$ and occurs in response to a system "wake-up" signal or equivalent.

For purposes of illustration and not intended to be limiting, source 2 is assumed to be a conventional band-gap reference voltage source and analog load 4 is assumed to be a low-noise analog-to-digital converter (ADC), but many other elements can be used for source 2 and load 4. Capacitance 12 can be internal or external to IC 51, but in many applications it is external because of its physical size. While it is desirable that the elements shown in circuit 51 are internal to an IC, this is not essential.

Sensor element 20' is analogous to element 20 of FIG. 2 and is conveniently provided by resistance 6' having value R. Sensor circuit 22' of system 50 comprises differential amplifier 52 having inputs 521, 522 coupled, respectively to nodes 8, 3' of sense element 20'. Output 523 of sensor circuit 22' is coupled to input 541 of charger circuit 24' and input 561 of buffer circuit 63.

Amplifier 52 is preferably an op-amp with very low or zero off-set voltage. The off-set voltage should be as small as can reasonably be obtained, e.g., desirably less than or equal to 10 millivolts, conveniently less than or equal to 5 millivolts and preferably less than about 1 millivolt. Unlike the arrangement of system 19, it is not necessary to provide a predetermined off-set voltage and the off-set voltage of amplifier 52 can be made zero. Off-set compensation arrangements are well known in the art. Amplifier 52 has further control input 524 whose function is discussed in connection with latch 58.

Output 523 of amplifier 52 is coupled to control input 541 of first variable current source 54, e.g., a transistor. In this example, transistor 54 is a P-type MOSFET but other transistor types can also be used taking into account the relative polarities needed therewith. First power terminal 542 of first current source 54 is coupled to DC power rail or connection 53. Second power terminal 543 of current source 54 is coupled via node 55 to input connection 7 of capacitor 12. Node 55 is also coupled to node 8, node 57 and input terminal 5 of load 4.

Output 523 of amplifier 52 is also coupled to control input 561 of second variable current source 56, e.g., a transistor. In this example, transistor 56 is a P-type MOSFET but other transistor types can also be used taking into account the relative polarities needed therewith. First power terminal 562 of second current source 56 is coupled to DC power rail or connection 53, e.g., VDD or VCC. Second power terminal 563 of second current source 56 is coupled via node 59 to current source 60 which is in turn is coupled to reference 61, e.g., GND.

Node 59 is also coupled to set input S ("S-bar") 581 of latch 58. Latch 58 has reset (RS) input 582 and Q output 583. Latch 58 is conveniently a set/reset flip-flop. Q output 583 is coupled to output 62 and to control input 524 of amplifier 52. Current source or impedance 60 can be an active source or a passive impedance, since its function is to pull node 59 to the potential of reference 61 after device 56 shuts off. An active current source is preferred. A transistor with its control input coupled to a fixed bias is suitable.

Variable current sources 54, 56 have their control inputs 541, 561 commonly connected and their first power terminals 542, 562 commonly connected to power rail 53. They function as a current mirror. The current flowing in device 56 mirrors the current flowing in device 54, that is, it is equal or proportional thereto. The current ratios depend upon the ratio of the device active areas. This is a significant aspect of the present invention. The operation of the circuit of FIG. 4 will now be described by way of a non-limiting example.

When Vi is applied (e.g., at time=0), filter capacitance 12 is initially discharged (i.e., Vo~0) and node 8 is at zero volts, so that (Vi−Vo) has its greatest value $(Vi-Vo)_{MAX}$. Vi appears across resistor 6' and across inputs 521, 522 of amplifier 52. When output 523 of amplifier 52 is low, e.g., at ~0 volts, current source 54 turns "ON", i.e., changes to a low impedance state. Transistor 56 also turns "ON". The current flowing through transistor 54 from power rail 53 rapidly charges capacitance 12. The voltage Vo at input 7 of capacitance 12 and input 5 of load 4 rises rapidly.

The internal impedance R' of current source 54 can be made much smaller than the value R of resistance 6' of the low pass filter so that the time constant R'C of charger circuit 24' in combination with capacitance 12 is much smaller than the RC time constant in FIG. 1, that is R'C<<RC. Thus, Vo rises much more rapidly with the arrangement of FIGS. 4–5 than with the circuit of FIG. 1.

As noted above, the output signal of amplifier 52 is also applied to control input 561 of device 56, thereby also placing it in its low impedance state at the same time as device 54. This causes S input 581 of latch 58 to go high, i.e., to be at or near the voltage of power supply rail 53. Most of the voltage difference between power supply rail 53 and reference 61 appears across current source 60, e.g., a resistor or a transistor operating in a comparatively high impedance mode.

When (Vi−Vo) approaches zero volts, the output of amplifier 52 rises, e.g., toward the voltage on rail 53. Variable current source 54 shuts off when Vo~Vi (assuming zero off-set). This is a particularly desirable feature when the voltage Vi is a reference voltage and Vo must be controlled to have substantially the same value. However, those of skill in the art will understand based on the description herein that an offset can also be provided, that is, Vo can have a value (Vi−Δ) where Δ is a predetermined amount, and the condition (Vi−Vo)~0 or Vi~Vo is intended to include the case where (Vi−Vo)~Δ for non-zero values of Δ. But where Vo is intended to be a precise reference potential equal to Vi, it is preferred that Δ be zero. A feature of the embodiments of the present invention illustrated in FIGS. 4–5, is that it provides reduced power consumption even for Δ or Vos equal to zero.

If the ongoing current drain presented by load 4 is small enough, the voltage drop across resistance 6, 6' can be neglected. If the current drain of load 4 increases, e.g., due to activities elsewhere in the overall system (not shown), then, as long as amplifier 52 is active, when (Vi−Vo)>0 current source 54 will turn on again until the condition (Vi−Vo)~0 is re-established.

However, in many cases where the current drain of load 4 is small, it is desirable to reduce the ongoing or stand-by current drain of the system by deactivating amplifier 52 and current sources 54, 56. This is accomplished by feedback buffer circuit 63 and latch 58. Buffer circuit 63 includes current sources 56, 60. Latch 58 is coupled back to a control input 524 of amplifier 52.

While capacitor 12 is charging, the signal from amplifier 52 turns on current source 56, in the same way that it turns on current source 54. In the ON state, the impedance of device 56 is small compared to the impedance of current source 60, there pulling S input 581 of latch 58 high (e.g., within a threshold of the potential of power rail 53). When Vo~Vi, the output of amplifier 52 goes high and device 56 shuts off, that is, assumes a high impedance state. Current source 60 then pulls node 59 to reference 61 (e.g., GND) thereby toggling S input 581.

After the switching delay associated with latch 58 changes state, Q output 583 goes high. Output 583 of latch 58 is coupled to control input 524 of amplifier 52. The control signal on input 524 of amplifier 52 makes amplifier 52 active or inactive, i.e., turns it "ON" or "OFF". When Q changes state in response to S going low, amplifier 52 is turned OFF and becomes inactive so that it consumes no significant power. The Q output from latch 58 is, optionally, also coupled to output 62 of circuit 51 where it is available as an indicator to the rest of the system (not shown) that Vo is stable and available. This is especially useful since the magnitude of the Q signal is independent of the magnitude of Vo and therefore much more convenient as a logic switching level for the rest of the system. Latch 58 does not toggle amplifier 52 OFF until Vo~Vi. When amplifier 52 is inactive, nodes 55, 8, 57 and terminals 5, 7 are maintained at Vo~Vi via resistor 6', so long as Vi>0.

The arrangement of FIG. 4 is a single ended system, that is, it provides accelerated charging but not accelerated discharging. This is adequate in most circumstances.

In the normal operation of the overall system, when source 2 is deactivated (e.g., Vi removed or set to zero) by a "go-to-sleep" signal, then Vo goes to zero. Node 55 is pulled down by the input impedance of load 4 and the output impedance of amplifier 52. In most cases this is sufficient. However, if a more rapid decay of Vo is desired, then persons of skill in the art will understand that an active pull-down can be included, e.g., driven by Vi so that when Vi>0, the pull-down is off and when Vi~0, the pull-down goes on. If, perchance, amplifier 52 is still active when Vi~0 and Vo is still high, it does not turn on charger circuit 24' because Vi−Vo has the opposite polarity compared to the "awake" condition Vi>0. If amplifier 52 is inactive, e.g., because it was turned off by latch 58, then it is insensitive to its inputs and Vi~0 does not affect it.

It will be noted that amplifier 52 and current sources 54, 56 are analog elements, that is, their output (up to saturation) is a continuous function of their input and they generally have no hysteresis, whereas latch 58 is a digital element, that is, it toggles between stable states without quasi-stable intermediate states and generally exhibits some hysteresis. The excellent performance of the present invention comes in part from using an analog element (feedback buffer 63) to drive a digital element (e.g., latch 58) in a feedback path to control an analog element (e.g., sensor circuit 22').

Input 524 of amplifier 52 can be an input which acts to disable or enable amplifier 52, or it can be the power terminal which supplies power to amplifier 52. Both approaches are intended to be included in the term "control input" 524. Persons of skill in the art will understand, based on the explanation herein, how to arrange to provide signals of the appropriate polarity to control input 524 in the manner desired.

A further feature of the present invention is the use of buffer circuit 63 to control latch 58. Buffer circuit 63 comprises current mirror device 56 and current source 60. It allows the switching of latch 58 to be controlled by different voltage levels than what appear on 12. It can be assured that amplifier 52 will not turn off prematurely, i.e., before Vo=Vi and that the system is stable and does not have any indeterminate states.

Amplifier 52 is desirably maintained in an active state for a predetermined period after the condition Vi~Vo is achieved, so as to have a time guardband. This is the sum of the time required for Vo to become stable and/or for node 59 to reach the switching potential for latch 58, plus the latch delay itself and any turn-off delay inherent in amplifier 52. Further, by using a bi-stable latch to accomplish this, especially one constructed from CMOS, there is no significant power drain from fast charging circuit 71 once the latch switching takes place and circuit 22' (e.g., amplifier 52) is turned off. The current paths in circuits 24' and 63 are also off.

Once latch 58 has toggled and turned amplifier 52 off, latch 58, amplifier 52, circuit 24' and circuit 63 remain in an inactive state. They can stay in that state for any desired time period, usually at least the time period for which the value of Vo is desired to be valid. This minimum time can be preset or programmable or variable. Latch 58 can be reset automatically after a predetermined time or, after a variable delay, can be reset by applying a signal to RS input 582.

In the preferred embodiment, amplifier 52 is reactivated by applying a reset signal on RS input 582 of latch 58, thereby causing Q output 583 to toggle back and reset control input 524 of amplifier 52 to the "active" state. At this point circuit 50 is re-armed and is ready to operate in the manner already described. Reactivation of amplifier 52 is generally performed anytime after Vi returns to zero, but it is desirable to reset amplifier 52 just prior to or coincident with the time that voltage reference (e.g., source 2) receives a "wake-up" signal from the remainder of the system (not shown). This means that RS input 582 is toggled (e.g., by a wake-up signal) at or just before the time when Vi goes high. In this way, amplifier 52 is only active when it is essential that it be active to speed up the charging of capacitor 12 and not otherwise. This minimizes stand-by power consumption.

Circuit 50 of FIG. 4 was tested in comparison to circuit 10 of FIG. 1 by simulation, with C=0.3 microFarads and RC=10 ms. Settling time $T_S$ of circuit 10 is about 3×RC=30 milliseconds. The settling time of circuit 50 for the same values of R and C is about 0.5 milliseconds. Thus, the time-to-availability of stable Vo is improved by about 30/0.5=60 times by use of the accelerating elements shown within dashed outline 71. This is a significant and very useful improvement.

FIG. 5 is a simplified schematic circuit diagram of a further embodiment similar to FIG. 4, but using an N-type MOSFET as the switch for charging capacitance 12. The same reference numbers are used for the same elements and primed or double-primed numbers are used to identify analogous elements in FIGS. 4 and 5.

The circuit of FIG. 5 differs from that of FIG. 4, in that inputs 521', 522' of amplifier 52' are reversed with respect to nodes 3', 8 and that output 523' of amplifier 52' is coupled to input 78 of variable impedance or current source 76. Variable impedance 76 is preferably an N-type MOSFET, but other device types can also be used. Current terminals 80, 82 of variable impedance 76 are coupled respectively to load device 54' and node 55'. Load device 54' is desirably a P-type MOSFET whose input 541' is tied to one of its own power terminals, e.g., at 542'. Other than the differences of polarities associated with the differing transistor types and amplifier input/output, circuit 50' functions in substantially the same manner as circuit 50.

While the arrangement and operation of circuits 19, 29, 50, 50' are described for specific examples and arrangement of elements, persons of skill in the art will understand based on the description herein that other types of elements may also be used that accomplish substantially the same function in substantially the same way without departing from the present invention. Accordingly, it is intended to include such variations in the scope of the claims that follow.

What is claimed is:

1. An electronic apparatus comprising:

a source having an output for providing a voltage Vi;

a load connection for receiving a voltage Vo whose rise time depends upon a capacitance coupled to the load connection;

a sensor circuit coupled to the source output and the load connection, for detecting Vi and Vo and providing an output signal related to (Vi−Vo);

a charger circuit for receiving the output signal of the sensor circuit and in response thereto, charging the capacitance until Vo~Vi; and a feedback circuit having a buffer and a latch, wherein the buffer and latch are coupled to the sensor circuit for temporarily deactivating the sensor circuit when Vo~Vi so that the sensor circuit does not respond to (Vi−Vo) until after Vi is turned OFF.

2. The apparatus of claim 1 further comprising a resistance coupled between the output of the source and a first terminal of the capacitance, wherein a second terminal of the capacitance is coupled to a reference potential and the first terminal of the capacitance is also coupled to the load connection, and wherein the sensor circuit derives its inputs from across the resistance.

3. The apparatus of claim 2 wherein the charger circuit comprises a current source having a first terminal coupled to a power supply line and a second terminal coupled to the capacitance and a control terminal actuated by the output signal of the sensor circuit, such that for Vi>0, the current source is substantially "ON" until Vo~Vi, and "OFF" thereafter until reset.

4. The apparatus of claim 1 wherein, after being deactivated, the sensor circuit remains deactivated until the latch is reset.

5. The apparatus of claim 2 wherein the buffer comprises a current source driven by the output signal of the sensor circuit, wherein an output of the buffer is coupled to the latch, wherein when Vi approximately equals Vo and after a delay determined in part by the latch, the latch makes a transition which is fed back to the sensor circuit.

6. A fast rise time, low noise circuit for providing a voltage Vo to a load connection, comprising:

a reference generator producing a voltage Vi on an output thereof;

a filter coupled between the reference generator output and the load connection for removing higher frequency noise from Vo, wherein a capacitance C appears at the load connection;

a sensor circuit having a first input terminal coupled to the reference generator output and a second input terminal coupled to the load connection, and an output; and a charger circuit actuated by the output of the sensor circuit for coupling the load connection to a first potential when Vo<(Vi−Vos), and to a second potential when Vo>(Vi+Vos'), where Vos and Vos' are off-set voltages smaller than Vi.

7. The circuit of claim 6 further comprising a feedback circuit for temporarily inactivating the charger circuit after Vo reaches the range (Vi−Vos)<Vo<(Vi+Vos').

8. The circuit of claim 6 wherein Vos has a value in the range 5≦Vos≦100 millivolts.

9. The circuit of claim 8 wherein Vos has a value in the range 10≦Vos≦70 millivolts.

10. The circuit of claim 6 wherein the filter comprises a resistance R, wherein the resistance R is coupled between the reference generator output and the load connection.

11. An apparatus for providing voltage Vo on a node thereof, comprising:

a generator circuit for providing a reference voltage Vi;

a filter having resistance R coupled between the generator circuit and the node and capacitance C coupled to the node, for removing higher frequency noise from Vo;

a variable impedance coupled between a DC potential connection and the node;

a differential amplifier having inputs, coupled to R, and an output, wherein the output controls the variable impedance so that rapid charging of C does not depend on R; and a feedback circuit for receiving an input signal from the output of the differential amplifier and having an output coupled to a control input of the differential amplifier for shutting off the variable impedance when Vo~Vi and then, after a delay, shutting off the differential amplifier to reduce further power consumption.

12. The apparatus of claim 11 wherein the feedback circuit comprises a latch which toggles between stable states, for one of which the differential amplifier is in an active state and for the other of which the differential amplifier is shut off, according to a signal provided by the latch to the control input of the differential amplifier.

13. The apparatus of claim 12 wherein the feedback circuit further comprises a current mirror driven by the differential amplifier in the same manner as the variable impedance and coupled to a "set" terminal of the latch and to a load impedance, wherein when Vi>Vo, the potential on the "set" terminal of the latch is such that the output of the latch maintains the differential amplifier in the active state, and when Vo~Vi the potential on the "set" terminal of the latch is such that the latch toggles, thereby shutting off the differential amplifier.

14. An apparatus for providing voltage Vo on a node thereof, comprising:

a voltage reference circuit for providing voltage Vi;

a low pass RC filter wherein resistance R is coupled between the voltage reference circuit and the node, and capacitance C is coupled to the node for removing higher frequency noise from Vo;

a variable current source coupled between DC potentials and to the node having Vo, wherein the variable current source has a first portion for charging C when Vo<Vi−Vos1, and a second portion for discharging C when Vo>Vi+Vos2, where Vos1 and Vos2 are off-set voltages greater than zero; and a differential amplifier coupled to R and driving the variable current source so that rapid charging and discharging of C does not depend on R.

15. The apparatus of claim 14 wherein Vos1 and Vos2 have values which are greater than about 5 millivolts and less than about 100 millivolts.

16. The apparatus of claim 15 wherein Vos1 and Vos2 have values which are greater than about 10 millivolts and less than about 70 millivolts.

17. The apparatus of claim 14 wherein the differential amplifier comprises a first differential amplifier driving the first portion and a second differential amplifier driving the second portion.

18. The apparatus of claim 17 wherein a positive input of the first differential amplifier is coupled to a positive input of the second differential amplifier and a negative input of the first differential amplifier is coupled to a negative input of the second differential amplifier.

19. The apparatus of claim 14 wherein Vost=Vos1+Vos2 is in the range of 2% to 20% of Vi.

20. The apparatus of claim 14 wherein Vost=Vos1+Vos2 is in the range of 4% to 10% of Vi.

* * * * *